United States Patent [19]

Takada et al.

[11] 4,347,787

[45] Sep. 7, 1982

[54] PRODUCT NAME STAMPING DEVICE OF LABEL PRINTERS

[75] Inventors: Yukihiro Takada, Shizuoka; Kimikazu Sugiyama, Shimokanuki Nishimura; Mithuo Imai, Shizuoka, all of Japan

[73] Assignee: Tokyo Electric Co., Ltd., Tokyo, Japan

[21] Appl. No.: 177,912

[22] Filed: Aug. 14, 1980

[30] Foreign Application Priority Data

Aug. 14, 1979 [JP] Japan ..... 54-103467

[51] Int. Cl.[3] ..... B41D 7/00

[52] U.S. Cl. ..... 101/333; 101/383

[58] Field of Search ..... 101/373, 368, 372, 383, 101/384, 405, 406, 335, 333

[56] References Cited

U.S. PATENT DOCUMENTS

| | | | |
|---|---|---|---|
| 2,526,311 | 10/1950 | Wilson | 101/401.1 X |
| 2,819,668 | 1/1958 | Mcaneny | 101/405 X |
| 2,899,895 | 8/1959 | Tannery | 101/405 X |
| 3,478,682 | 11/1969 | Funahashi | 101/373 X |
| 3,885,495 | 5/1975 | Funahashi | 101/335 |
| 3,949,672 | 4/1976 | Cadmus, Jr. | 101/368 |
| 3,971,315 | 7/1976 | Hansen | 101/333 |
| 3,988,987 | 11/1976 | Ikura et al. | 101/368 |
| 4,038,918 | 8/1977 | Funahashi | 101/368 X |
| 4,054,093 | 10/1977 | Funahashi | 101/372 X |
| 4,180,197 | 12/1979 | Raasch | 101/335 |

FOREIGN PATENT DOCUMENTS

| | | | |
|---|---|---|---|
| 921189 | 3/1963 | United Kingdom | 101/368 |

*Primary Examiner*—E. H. Eickholt

*Attorney, Agent, or Firm*—Oblon, Fisher, Spivak, McClelland & Maier

[57] ABSTRACT

A product name stamping device of the label printers in which an ink-soaked member is provided to the stamp holder and a light and small ink-soaking member which contacts the ink-soaked member of the holder is fitted to the stamp. This construction make the stamp small and compact. The compactness of the stamp makes easy the handling and storage of a large number of stamps and also spares material bringing about a reduction in cost. The device is so constructed that setting the stamp into the holder automatically supplies ink to the stamp.

3 Claims, 20 Drawing Figures

PRODUCT NAME STAMPING DEVICE OF LABEL PRINTERS

BACKGROUND OF THE INVENTION

1. Field of the Invention

This invention relates to a product name stamping device of label printers. The label printer usually has a very large number of stamps stored as accessories from which a desired stamp is chosen.

2. Description of the Prior Art

In the conventional label printers, the stamp is fitted with an ink-soaked member, which is necessarily large in volume in order to print the product name on a large number of labels successively without supplying additional ink. This makes the stamp large. Furthermore, to securely hold the ink-absorbed member, the stamp must be produced by plastic-molding. This requires complicated production processes resulting in an increase in cost.

SUMMARY OF THE INVENTION

A first object of this invention is to simplify the stamp by providing an ink-soaked member to the label printer side.

A second object is to increase the ink-retaining capability of the ink-soaked member provided to the label printer side and to enable an easy supply if ink to the stamp.

A third object is to prevent the stamp from being fouled by the ink-soaked member when the stamp is being inserted or removed from the holder.

A fourth object is to enable the label printer to use different sized of stamps and change the position of the stamp.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
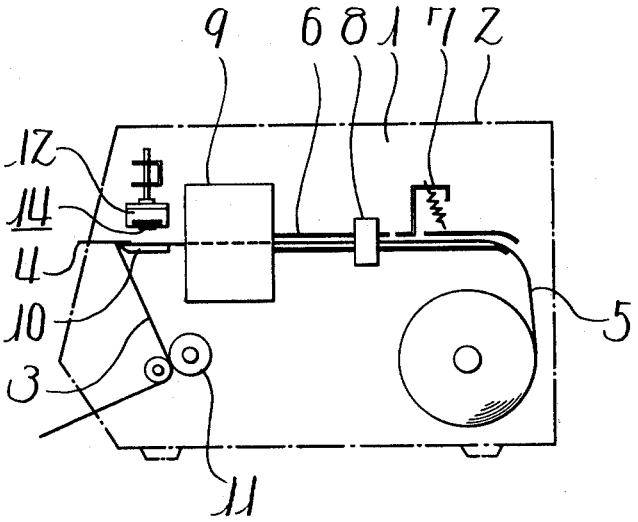
FIG. 1 is a vertical side cross section of the label printer of one embodiment according to this invention.
Figure 2:
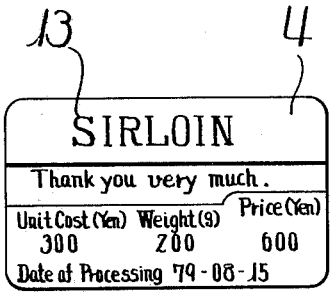
FIG. 2 is a plan view of the label.
Figure 3:
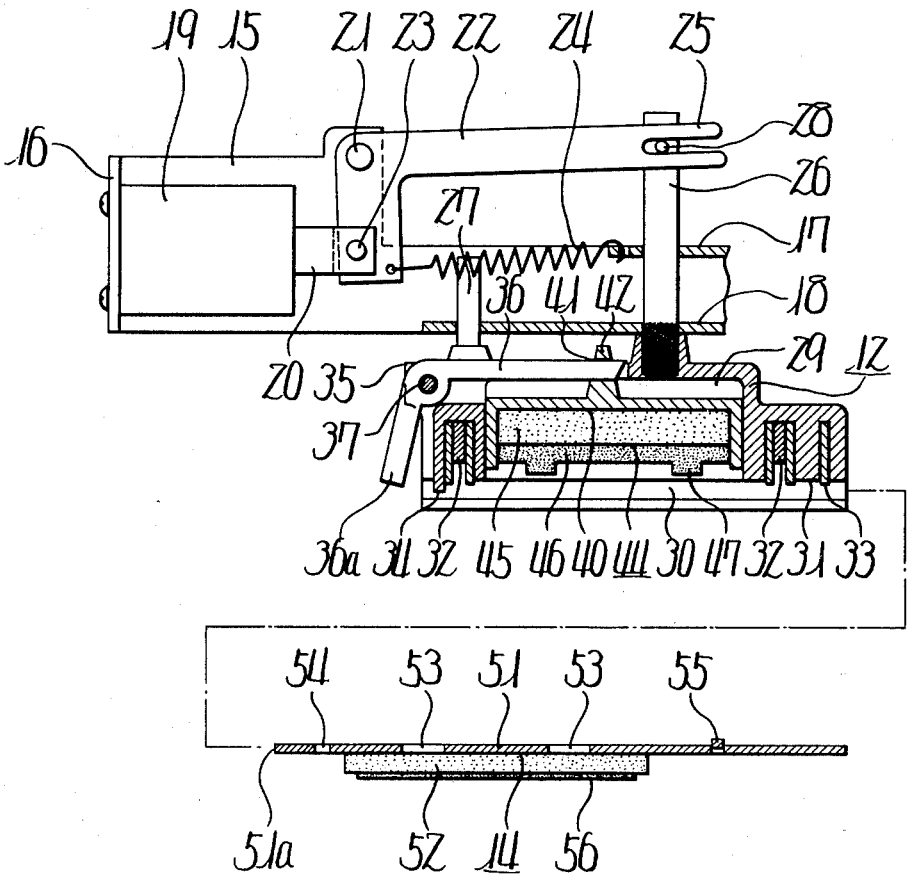
FIG. 3 is a vertical front cross section of a main portion.
Figure 4:
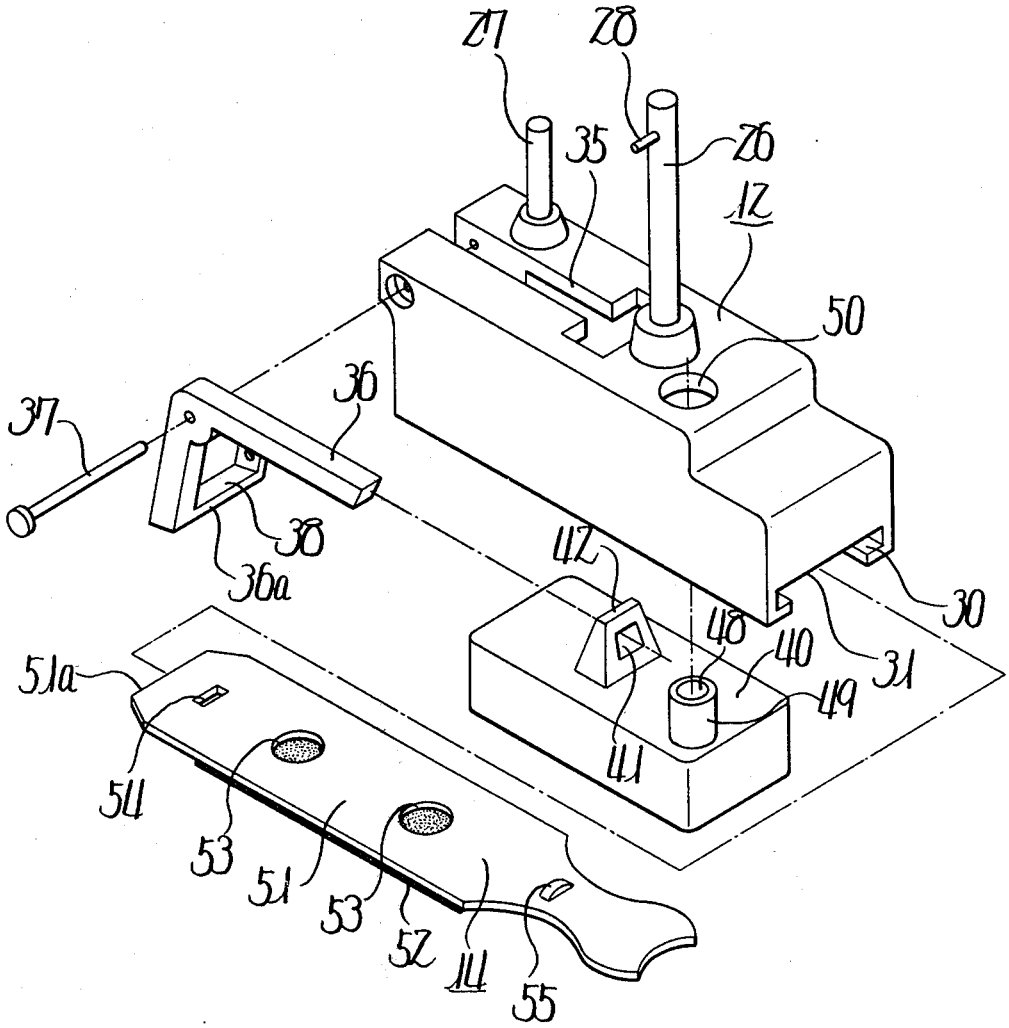
FIG. 4 is a perspective view of the main portion disassembled.
Figure 5:
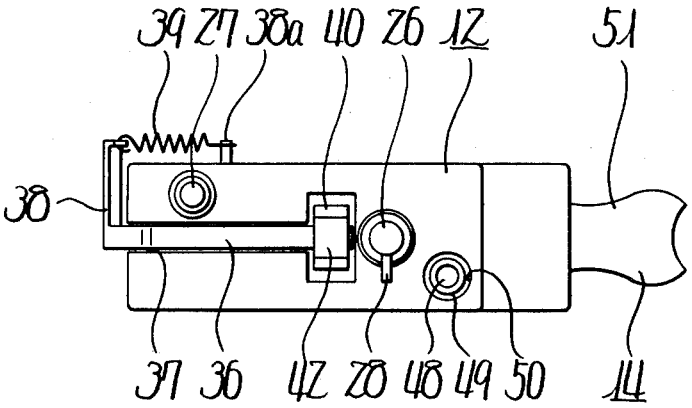
FIG. 5 is a plan view of the stamp and holder.
Figure 6:
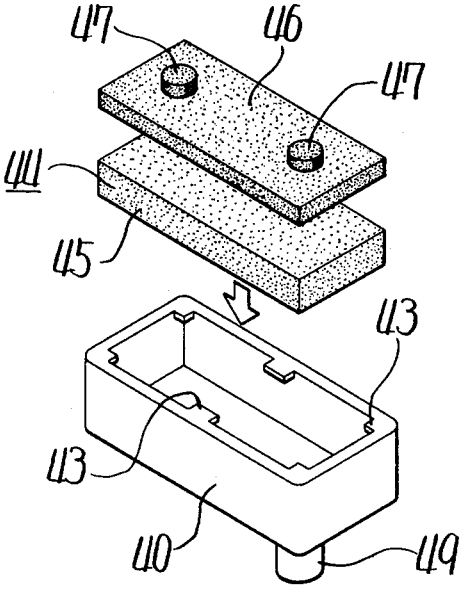
FIG. 6 is a perspective view of a case and an ink-soaked member disassembled and placed upside down.
Figure 7:
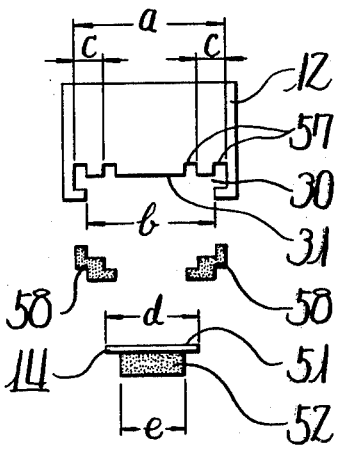
FIG. 7 is a side view of the holder and the stamp, disassembled, of a second embodiment.

One embodiment of this invention will now be described with reference to FIGS. 1 through 6. The label printer 1 contains in its case 2 a rolled strip of label paper 5 including a number of rectangular labels 4 adhering to a narrow strip of back paper 3. Also formed in the case 2 is a passage 6 for the label paper 5, along which are provided a label guide 7 for applying a braking force to the label paper 5, a label detector 8 for detecting the position of the label 4, a printer 9 for printing data on the label 4 such as the unit price, weight, total price and the data of manufacture, and a separator plate 10 for separating the label 4 from the back paper 3 by abruptly bending the back paper 3. Below these components is provided a feed roller 11 that intermittently feeds the back paper 3 a predetermined distance. The separator plate 10 whose upper surface is plane and flat also serves as a stamp base, above which a vertically movable product name stamp holder 12 is provided.

The label 4 has a certain format, on which data such as the unit price, weight, total price and the data of processing are printed by the printer 9. The upper blank space of the format will be printed with the product name 13 such as "sirloin" by the stamp 14 supported by the holder 12.

The case 2 also contains a frame 15 rigidly secured to it. The frame 15 has bent portions 16, 17, 18. Secured to the bent portion 16 of the frame 15 is a solenoid 19 as a drive source lying in a horizontal position with its movable core 20 linked by a pin 23 to an L-shaped drive arm 22 rotatably supported on a shaft 21, which is secured to the frame 15. The drive arm 22 is urged counterclockwise by a tension spring 24 stretched between it and the bent portion 17. The drive arm has a fork-like connecting portion 25 at the end.

The product name stamp holder 12 has a main shaft 26 and a rotation preventing shaft 27, both standing upright in parallel with each other, with the main shaft inserted through the bent portions 17, 18 and the rotation preventing shaft 27 inserted through the bent portion 18 so that both shafts are vertically movable relative to the frame 15. The main shaft 26 has a connecting pin 28 secured thereto for engagement with the connecting portion 25 of the L-shaped drive arm 22. The product name stamp holder 12 has a recess 29 of rectangular shape that opens downwardly and, on its underside, two longitudinally extending grooves 30 facing each other. At the bottom surface 31 which forms the upper edge of the grooves 30, the holder 12 has two permanent magnets 32, a stopper 33 and a retaining projection 34. It also has a T-shaped opening 35 at the central portion in which an L-shaped lever 36, a link mechanism, is rotatably supported near its central portion on a pin 37. The lever 36 has a spring support 38 at its tail, projecting sideward. The lever is urged counterclockwise by a tension spring 39 which is stretched between the spring support 38 and a projection 38*a* fitted to the side of the stamp holder 12. A case 40 contained in the recess 29 is vertically movable. The case 40 has at the center of the upper surface a projection 42 with an opening through which the front end of the lever 36 is inserted. The case 40 also has a plurality of engagement projections 43 protruding inwardly from the lower edge of the opening. This case 40 can be pushed out of the holder 12 by rotating the lever 36 clockwise against the tension of the spring 39. This case 40 contains an ink-soaked member 44 made of such material as sponge, which is made up of two layers stacked one upon the other. The upper layer 45 of the ink-soaked member 44 has high ink-soaking capability but low ink-retaining capability while the lower layer 46 has high ink-retaining capability but low ink-soaking capability. The lower layer 46 has two projections 47 on the undersurface. On its upper surface, the case 40 has a tube 49 projecting upward through and beyond the opening 50 of the holder 12. The tube 49 forms an ink supply passage 48.

The product name stamp 14 includes a steel plate 51 and an ink-soaking member 52. The steel plate has the width equal to the distance between the parallel grooves 30 and the thickness smaller than the depth of the grooves, and the ink-soaking member 52 is bonded to one side of the steel 51. The steel plate 51 has two holes 53 at positions corresponding to the projections 47; a hole 54 to receive the elastic retainer projection 34; a projection 55 for engagement with the stopper 33; and a front edge 51*a* for engagement with the leg 36*a* of the lever 36. The ink-soaking member 52 has on its underside a stamping portion 56 on which a product name 13 is stamped.

The stamp or seal 14 used in this label printer is selected from among a large number of seals, for example 1000 seals, which are neatly kept in the specially designed case. The manner in which the product name seal 14 is placed in position will now be explained. The steel plate 51 is aligned with the grooves 30 and inserted into it. At this time, the steel plate 51 is attracted by the permanent magnets 32 but since the direction of attraction is perpendicular to the direction in which the steel plate is pushed in, the inserting action is only slightly resisted. As the steel plate 51 is inserted, the front edge 51*a* abuts against the leg 36*a* of the lever 36 rotating the lever 36 clockwise to force the case 40 downward, with the result that the projections 47 of the ink-soaked member 44 are moved through the holes 53 to come into contact with the ink-soaking member 52. At the same time, the resilient retainer projection 34 comes into the hole 54, so that the stamp 14 will not come out undesirably when pushed by the lever 36. The projection 55 also abuts against the stopper 33 preventing the seal 14 from advancing any further. Although there is a play in vertical direction between the steel plate 51 and the grooves 30, the steel plate 51 will not move relative to the holder 12 because the steel plate 51 is attracted by the magnets 32 to the undersurface 31 of the holder 12. The seal 14 can be drawn out by simply pulling it horizontally. A slight backward displacement of the seal 14 allows the lever 36 to be reset, causing the case 40 to be lifted and the projections 47 to come out of the holes 53. Thus, the ink-soaked member 44 is prevented from contacting and fouling the surface of the steel plate 51 during the process of attaching and detaching the seal 14.

Since the ink-soaking member 52 of the seal 14 is only required to transfer the ink supplied from the ink-soaked member 44, a small and simple ink-soaking member will do. So, a large number of product name seals 14 can be produced with a reasonably low cost. When the label printer 1 has run out of ink, the ink can easily be supplied to the large volume ink-soaked member 44 through the ink supply passage 48. The ink-soaked member 44 can absorb a large amount of ink in the upper layer 45 with high ink-soaking capability and the ink is transferred to the ink-soaking member 52 of the seal 14 through the lower layer 46 with high ink-retaining capability.

Now, a second embodiment of this invention will be explained with reference to FIGS. 7 through 10. The components that are identical to those in the preceding embodiment are assigned the same reference numerals, and explanation on them will be omitted here. In this embodiment, the position of the product name seal 14 relative to the holder 12 can be adjusted to cope with the cases where the size of the label 4 adhering to the back paper 3 is changed or where the position of the blank space of label format on which the product name is to be printed is changed. It should be noted that a stands for the distance between the two grooves in the holder 12, b for the distance between the lowest inner edges of the opening, c for the distance between the adjacent two rectangular grooves 57, which are one of two pairs of grooves cut in the bottom surface 31 along each groove 30, d for the width of the steel plate 51 of the product name seal 14, and e for the width of the ink-soaking member 52. The width d is determined as (a-2c). Two adapters 58 are fitted into the grooves 30 and 57 to support the product name seal 14. The distance between the two adapters 58 is slightly greater than the width e of the ink-soaking member 52.

Figure 8:
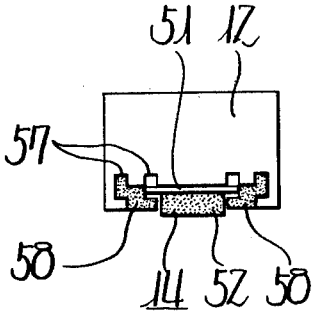
FIGS. 8 through 10 are side views showing the stamp fitted into the holder.
Figure 9:
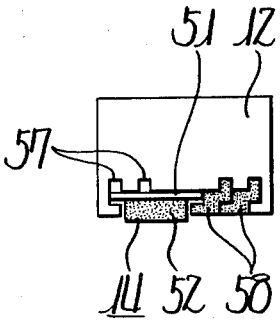
Figure 10:
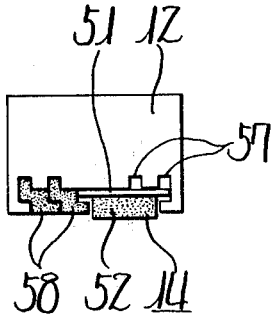

If the adapters 58 are fitted to the grooves on each side, the product name seal 14 will be positioned at the center, as shown in FIG. 8; if they are both fitted into the grooves on the right side of the holder 12, the seal 14 will be shifted to the left-hand side, as shown in FIG. 9; and if they are both fitted into the left-hand side grooves, the seal 14 will be shifted to the right-hand side, as shown in FIG. 10. Thus, by changing the combination of adapters it is possible to adjust the position of the seal 14. This enables the label printer to use different sizes of label 4 with different format.

Instead of using the two adapters of the same shape, it is also possible to use two adapters of different shapes with widths such that the sum of the widths of the two adapters is 2*c*. In this case, if one of the paired adapters is given a certain width, the width of another adapter is automatically determined. These two adapters are fitted to each side of the seal 14, as shown in FIG. 8.

Figure 11:
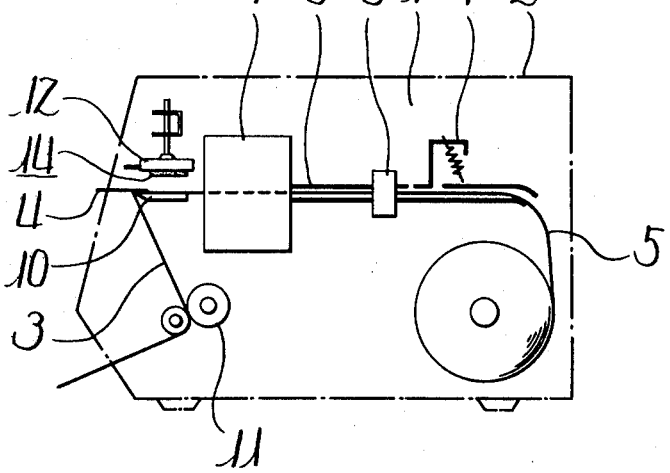
FIG. 11 is a vertical side cross section of the label printer of a third embodiment.
Figure 12:
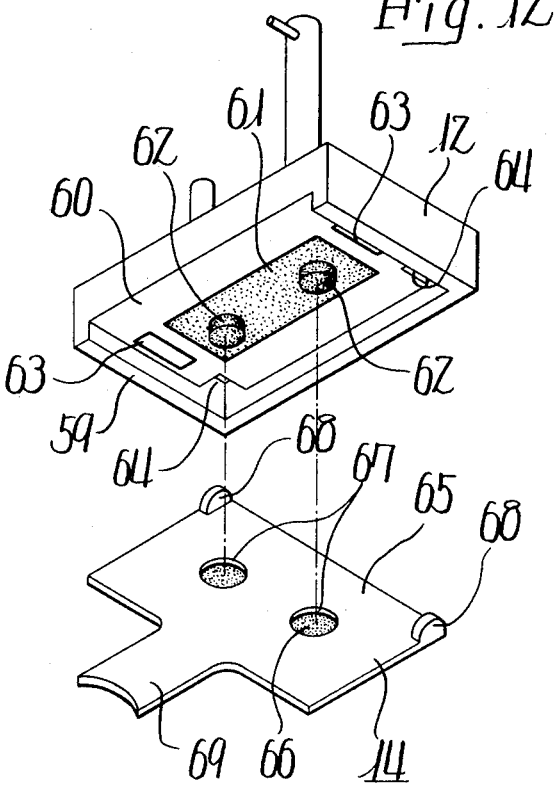
FIG. 12 is a perspective view of the stamp and the holder disassembled.
Figure 13:
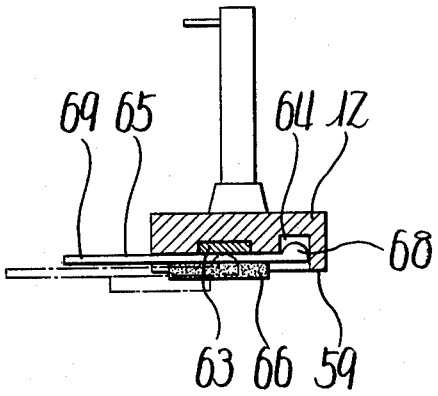
FIG. 13 is a vertical side view of the stamp set in the holder.
Figure 14:
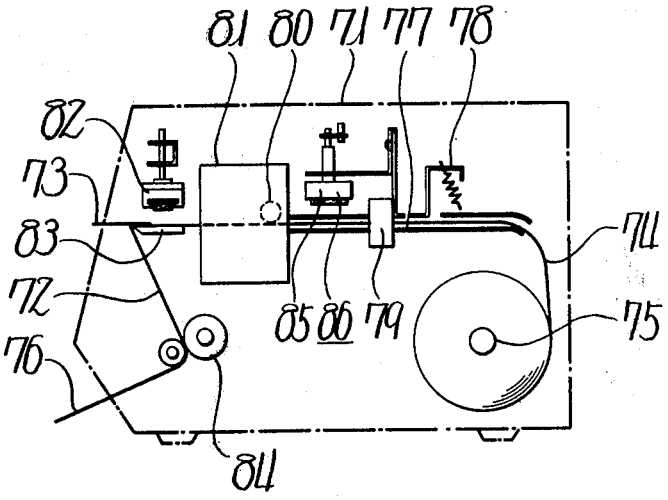
FIG. 14 is a vertical side cross section of the label printer of a fourth embodiment.
Figure 15:
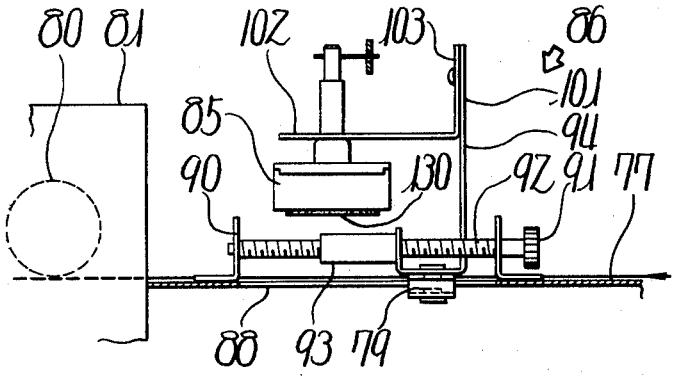
FIG. 15 is a side view of a main portion.
Figure 16:
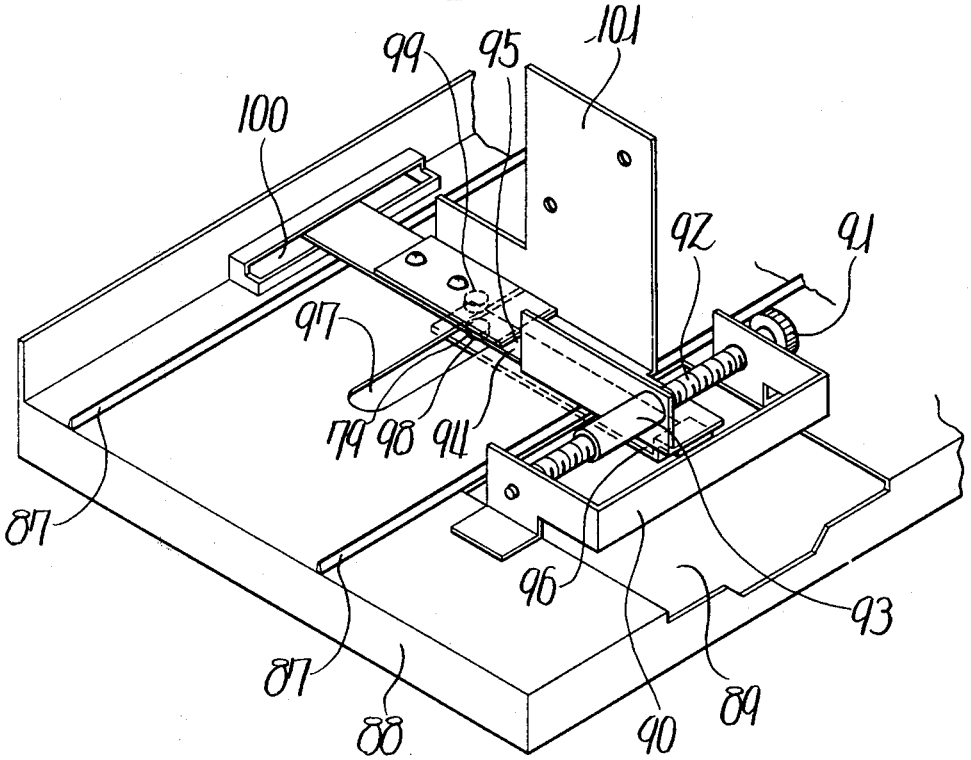
FIG. 16 is a perspective view of the main portion with some parts removed.
Figure 17:
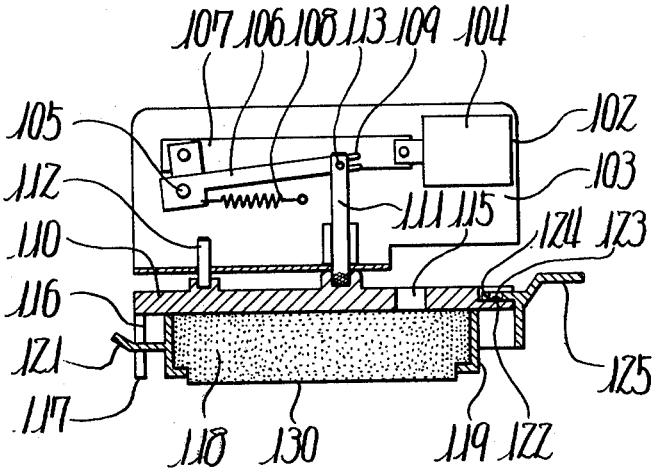
FIG. 17 is a vertical front cross section of the main portion.
Figure 18:
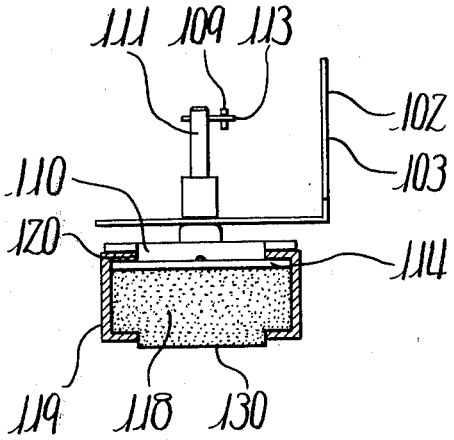
FIG. 18 is a vertical side cross section of the main portion.

A third embodiment of this invention will be explained with reference to FIGS. 11 through 13. In this embodiment the product name seal 14 is assembled into the holder 12 from the front side of the label printer 1. The holder 12 has its bottom surface 60 recessed a predetermined depth up from the guide edge 59 with its front edge cut off. Securely fitted into the central portion of the bottom surface 60 is an ink-soaked member 61 which has two projections 62 protruding downwardly. Two permanent megnets 63 are embedded into the bottom surface 60 on each side so that they are flush with the surface. The bottom surface 60 is also formed with recesses 64 at the rear corners.

The product name seal 12 includes a steel plate 65 and an ink-soaking member 66 bonded to the plate. The width of the steel plate 65 is equal to the distance between the guide edges 59. The steel plate 65 has two holes 67 cut through the central portion at positions corresponding to the projections 62. The steel plate 65 also has two projections 68 at the rear corners that fit into the recesses 64, and a handle portion 69 formed on the front side. The projections 68 are set higher than the projections 62 of the ink-soaked member 61.

With this construction, the seal 14 is inserted into the holder 12 from the front side. As it is inserted, the projections 68 contact the bottom surface 60. This prevents the projections 62 of the ink-soaked member 61 from contacting the surface of the steel plate 65. When the seal 14 is completely inserted, the projections 68 fit into the recesses 64. This allows the steel plate 65 to be attracted by the permanent magnets 63 so that the plate comes into a tight contact with the bottom surface 60. At the same time, the projections 62 of the ink-soaked members 61 fit into the holes 67 thus coming into contact with the ink-soaking member 66. When the seal 14 is being removed, the projections 68 contact the bottom surface 60, keeping the projections 62 from contacting the steel plate 65. If should be noted that this construction can also be applied to the first embodiment in which the seal is inserted from the side.

Now, a fourth embodiment of this invention will be explained with reference to FIGS. 14 through 20. In the body case 71 there is provided a container 75 that contains the rolled strip of label paper 74 which includes a number of blank labels 73 adhering equidistantly to the narrow strip of back paper 72. A passage 77 for the label paper 74 is formed extending from the container 75 to the outlet 76 on the front side. Provided along the passage 77 are, from the container 75 to the outlet 76, a label guide 78, a printer 81 having a detector 79 and a printing stamp 80 for printing data on the labels, a label separator 83, and a feed mechanism for feeding the back paper 72 intermittently. The detector 79 and a format printing mechanism 85 are assembled as one unit 86. The format printing mechanism 85 is built up on a base 88 which is formed with guides 87 for guiding the label paper 74. The base has an opening 89 outside the guides 87, across which a U-shaped frame 90 bridges with its legs secured onto the base. A threaded rod 92 with a knob 91 at one end is rotatably supported by the opposing portions of the frame 90, with a cylindrical piece 93 screwed over the threaded rod 92. Rigidly secured to the cylindrical piece 93 is a holder 94 which has upper and lower legs 95, 96 with upper leg 95 located above the base 88 and the lower leg 96 extending under the base from the opening 89. The base 88 also has a long slot 97 at the central portion, extending in the direction of label feed. The upper and lower legs 95, 96 have a slight emitting element 98 and a light receiving element 99 located at portions immediately above and below the slot 97 to form a label detector 79. The upper leg 95 is inserted at one end into the slider hole 100 in the base 88 to prevent the vertical motion of the leg. The rear portion of the leg 95 is bent upwardly to form a support plate 101, to which an L-shaped frame 102 is secured. Mounted to the vertical portion 103 of the frame 102 are a solenoid 104 and a drive arm 106, both interconnected through a link 107. The drive arm 106 is biased by a spring 108 under tension so that the fork-like connecting portion 109 at the end of the drive arm 106 tends to move upwardly. A main shaft 111 and a rotation preventing shaft 112 of the stamp holder 110 are both slidably inserted through the horizontal portion of the frame 102. The main shaft 111 has a pin 113 secured to the top end, which in turn engages with the connecting portion 109. The holder 110 has retaining ribs 114 at the front and the back and an ink supply hole 115 at the center. It also has an edge portion 117 with a retaining hole 116 at one end. Also attached to the holder 110 is a case 119 for holding a spongy rubber 118. The case 119 has a groove 120 that engages with the retaining rib 114; a projection 121 that fits into the retaining hole 116; a slippage preventing projection 124 with a hole 123 that receives the projection 122 formed on the holder 110; and a handle 125. The rubber stamp 118 has its stamping surface 130 carved to print the label with the format 129 consisting of the store name "TEC store", other items 127 such as "unit price", "weight", "total price" and "date of processing", and of lines 128.

Figure 19:
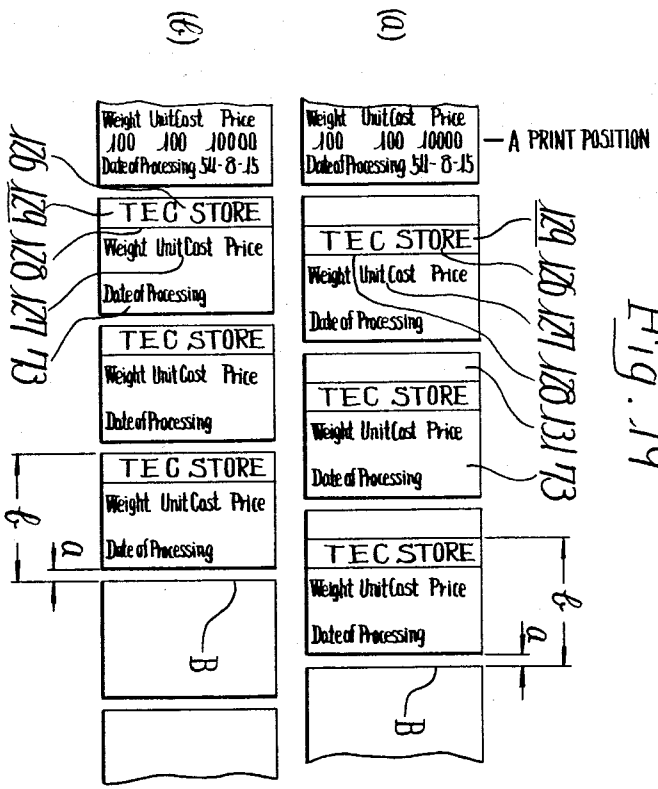
FIGS. 19(*a*) and (*b*) are plan views of labels showing the arrangement and format of the label.
Figure 20:
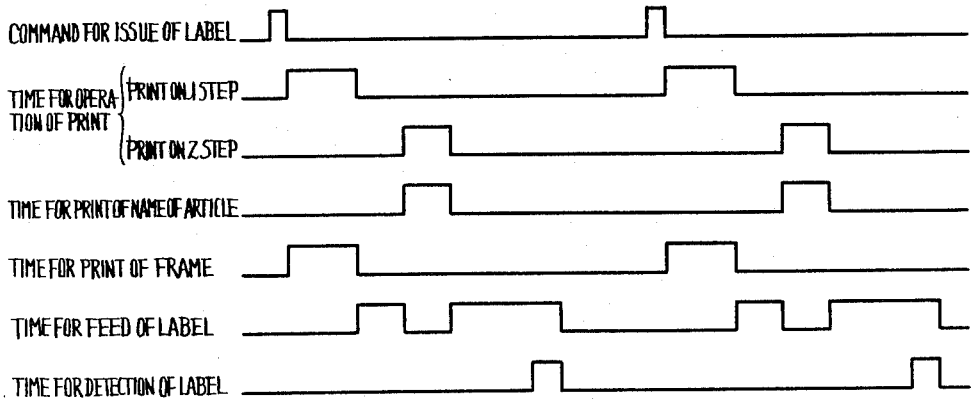
FIG. 20 is a timing chart.

With this label printer various kinds of labels 73 can be obtained. Two kinds of labels are taken as examples, as shown in FIGS. 19(*a*) and (*b*), with the one shown in (a) having a space for printing of a product name. The sizes of these two labels 73 are of course different. But the intervals a between the labels are usually constant to make effective use of the back paper 72. Either the front or rear edge of the label 73 may be used to determine the position of the label by the detector 79. However, it is preferable to use the front edge as the reference position B to prevent errors due to overrun of the label paper 74.

When the reference position B is detected, the feed mechanism 84 stops bringing the label paper 74 to a halt. The label printer must be adjusted so that when the label paper 74 is halted, the blank space for data such as weight, unit price and total price that are the first items to be printed corresponds to the printing position A of the stamp 80 of the printer 81. To make this adjustment the unit 86 made up of the detector 79 and the format printing mechanism 85 is moved to a desired position by turning the knob 91 of the threaded rod 92. Wherever the reference position B, the format 129 will be printed so that its front end corresponds to the reference position B. Thus, the format can be printed on the label of any size as long as the width of the printing surface 130 of the stamp is within (b-a).

With the above adjustment completed, a label issuing command is generated to effect the printing of both the format 129 and the data. The label paper 74 is then fed for a predetermined duration set by the timer, after which it is stopped and printed with the date of processing. At this time, the product name printer 82 is also actuated to print the product name, where necessary. After this, the feed mechanism 84 is actuated to feed the label. When the reference position is detected by the detector 79, the label paper is stopped. By repeating this process the blank labels 73 are continually printed with the format 129 and the data. The labels printed with necessary data are then separated from the back paper by the separator 83.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A product name stamping device of label printers comprising:

a reciprocable stamp holder;

an ink-soaked member contained in the holder and made of spongy material that retains ink therein, the ink-soaked member having a plurality of projections on a first side thereof; and a stamp insertable in or removable from the holder, wherein the stamp further comprises a base plate of hard material having a plurality of holes formed therein into which the projections of the ink-soaked member fit and an ink-soaking member formed with a stamping portion on which a product name is stamped wherein said projections can contact said ink soaking member to transmit ink from said ink soaked member to said ink soaking member.

2. A product name stamping device of label printers as set forth in claim 1, wherein the base plate of the stamp further comprises a steel base plate.

3. A product name stamping device of label printers comprising:

a reciprocable stamp holder;

an ink-soaked member made of spongy material for retaining ink therein, the ink-soaked member having a plurality of projections on a first side thereof;

a case containing the ink-soaked member and movably mounted in the holder;

a stamp insertable in and removable from the holder by sliding along the length of the ink-soaked member, wherein the stamp further comprises a hard base plate with a plurality of holes formed therein into which the projections of the ink-soaked member fit and an ink-soaking member formed with a stamping portion on which a product name is stamped; and a link mechanism which, when the stamp is positioned within the holder, causes the case to move downwardly so that the projections of the ink-soaked member fit into the holes of the base plate.

* * * * *